US009032970B2

(12) United States Patent
Szarvas

(10) Patent No.: US 9,032,970 B2
(45) Date of Patent: May 19, 2015

(54) CIGARETTE FILTER

(75) Inventor: Tibor Szarvas, Budapest (HU)

(73) Assignees: Peter Szollosi, Budapest (HU); Jeno Csanyi, Budapest (HU)

( * ) Notice: Subject to any disclaimer, the term of this patent is extended or adjusted under 35 U.S.C. 154(b) by 870 days.

(21) Appl. No.: 13/266,602

(22) PCT Filed: Apr. 30, 2009

(86) PCT No.: PCT/HU2009/000041

§ 371 (c)(1),
(2), (4) Date: Jan. 30, 2012

(87) PCT Pub. No.: WO2010/125412

PCT Pub. Date: Nov. 4, 2010

(65) Prior Publication Data

US 2012/0132219 A1 May 31, 2012

(51) Int. Cl.

| | |
|---|---|
| ***A24D 3/16*** | (2006.01) |
| ***A24D 3/14*** | (2006.01) |
| ***A24D 3/08*** | (2006.01) |

(52) U.S. Cl.

CPC .. *A24D 3/14* (2013.01); *A24D 3/08* (2013.01); *A24D 3/16* (2013.01); *A24D 3/166* (2013.01)

(58) Field of Classification Search

None

See application file for complete search history.

(56) References Cited

U.S. PATENT DOCUMENTS

| | | | | |
|---|---|---|---|---|
| 3,878,854 | A * | 4/1975 | Albein et al. | 131/331 |
| 6,470,894 | B2 * | 10/2002 | Hersh et al. | 131/334 |
| 7,302,954 | B1 * | 12/2007 | Shigematsu et al. | 131/334 |

FOREIGN PATENT DOCUMENTS

| | | |
|---|---|---|
| EP | 1238594 | * 11/2002 |
| WO | WO/02/32239 | * 4/2002 |
| WO | WO/03/070367 | * 8/2002 |
| WO | WO/2009/081214 | * 7/2009 |

* cited by examiner

*Primary Examiner* — Michael J Felton

(74) *Attorney, Agent, or Firm* — Faegre Baker Daniels LLP

(57) ABSTRACT

The invention relates to a special, highly efficient cigarette filter. In particular, the invention relates to a new cigarette filter, in which materials of natural origin not used before in this special field are applied. More particularly, the present invention relates to a special, highly efficient cigarette filter, which can be used favorably for adsorbing the toxic components of the cigarette smoke, and neutralizing the free radicals produced during burning of the cigarette.

6 Claims, 1 Drawing Sheet

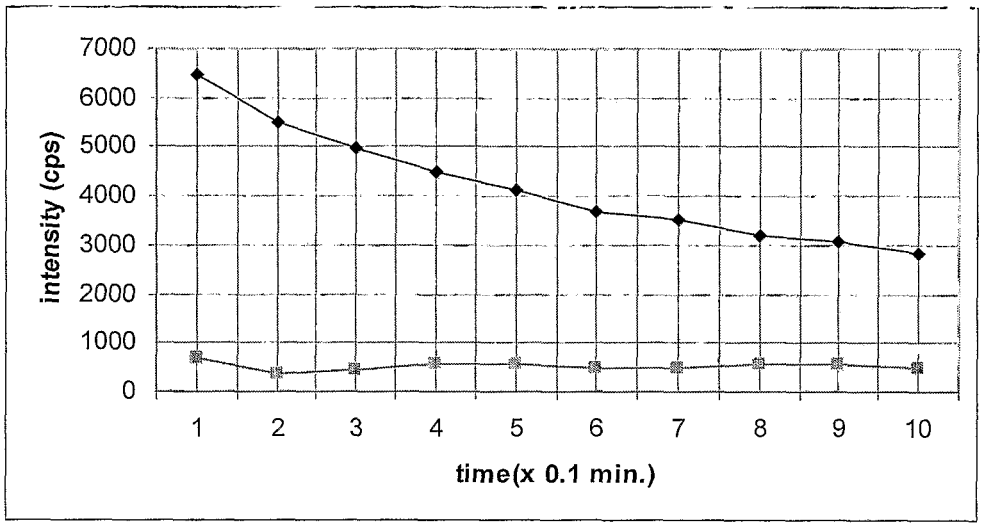
7000
6000
5000
4000
3000
2000
1000
0
intensity (cps)
1
2
3
4
5
6
7
8
9
10
time(x 0.1 min.)

CIGARETTE FILTER

CROSS-REFERENCE TO RELATED APPLICATION

This application is a National Stage filing of International Application Serial No. PCT/HU2009/000041 filed Apr. 30, 2009, the disclosure of which is expressly incorporated herein by reference.

The present invention relates to a special, highly efficient cigarette filter. In particular, the present invention relates to a new cigarette filter, in which materials of natural origin are used that have not been applied in this special field before. More particularly, the present invention relates to a special, highly efficient cigarette filter, which, when combined with the known cellulose acetate filter can be used favorably for adsorbing the toxic components of the cigarette smoke, and neutralizing the free radicals produced during the burning of the cigarette.

Especially, the cigarette filter according to the present is also suitable for eliminating genotoxicity in biological samples and eliminating the free radicals due to its high antioxidant capacity (SCE=Sister Chromatid Exchange, FACS=Fluorescence Activated Cell Sorter, AOX=Antioxidant); significantly decreases the amount of $^{210}$Po, one of the main factors responsible for cancer occurring in the tobacco only; decreases the amount of polycyclic aromatic hydrocarbons (PAH), especially benzo(a)pyrene, lowers the amount of heavy metal elements.

Tobacco smoking is a widespread, harmful human passion, which is known, to cause serious and irreversible health damage. Currently, smoking is the leading cause among the different factors of incurable cancer diseases. Health damage caused by smoking generates serious social and financial problems worldwide. For example, only in the EU countries premature death of more than 500,000 people is caused by the harmful effects of smoking.

As a consequence of the above, it is quite natural that the entire world endeavors to drive back smoking and relieve the damages caused by the tobacco smoke. This can partly be achieved by giving up smoking or persuading the people to wean from smoking, and partly by using means, which filter the tobacco smoke to the most possible extent before entering the human body.

For decades the most widespread and generally applied means for the latter solution has been the cigarette filter. Currently the filter itself is a segment integrated directly into the cigarette, at one end of it, which is installed in a way that the cigarette smoke can enter the airways and lungs through it only. The amount of harmful substances in the cigarette smoke can efficiently be reduced by cigarette filters. Thus, researchers are highly interested in constructing a cigarette filter, which considerably reduce, or prevent the fatal consequences of smoking.

It is known that tobacco smoke contains several thousand chemical substances, among them mostly the following are responsible for the development of many diseases. (for ex. Cardiovascular diseases, respiratory diseases and cancer, etc. . . . )

- nicotine
- tar
- carbon monoxide
- nitrosamines
- polycyclic aromatic hydrocarbons (benzo(a)pyrene)
- nitrogen oxides
- hydrogen cyanide
- heavy metals

- a polonium radioisotope (accumulates in the tobacco plant)

etc.

The prior art contains several solutions directed to filtration of the harmful substances of the tobacco smoke, and also, a large number of patent applications in this field have been filed in the last decades.

Until now different materials or additives have been applied for improvement of the cigarette filters.

JP 59-71677 describes a filter component which comprises porous natural substances containing magnesium silicate as main component, tea-leaf extract, coffee bean extract and chestnut tannin on a surface.

JP-5-115273A discloses tobacco obtained by admixing epigallocatechin gallate from green tea with the tobacco itself and with the filter parts.

JP-5-2315991A describes a tobacco filter comprising ellagic acid. Nevertheless, it is impossible to eliminate the tar component effectively with keeping the aroma and palatability.

On the other hand, JP-63-248380A suggests the use of active carbon. Active carbon is a superior adsorbent for many of the smoke's ingredient indeed, even for free radicals, but it has also disadvantageous influence on the taste and palatability.

Chinese Patent No. 1145206A discloses a filter containing polyphenol extracted from tea, vitamin C and active carbon.

U.S. Pat. No. 7,302,954 discloses a cigarette filters comprising grape proanthocyanidin extracts using porous materials or cellulose acetate filter as carrier. Pure proanthocyanidine has an excellent effect in eliminating free radicals from the tobacco smoke. However, this patent suggests a time-consuming and expensive extraction procedure using water and hydrated alcohol, purification of the extract which provides a liquid or semi-solid form material. This material can be used as a proanthocyanidin-containing condensate or dried proanthocyanidin by removing the extracting solvent from the extract solution by vacuum destillation, spray-drying or lyophilization. All these procedures long-lasting and require a high amount of energy. Further, the patent does not suggest, that the corresponding components of the grape can be used in other forms having significantly improved effect.

Recent researches are focusing not just on the reduction of the amount of tar, nicotine and carbon monoxide, but also on the other components of the cigarette smoke—mainly for the elimination of the free radicals—which are mainly responsible for the development of the respiratory diseases. It was found that about 600,000 free radicals enter the lung with a single whiff. This effect can exactly be measured with a suitable technique, for example by the determination of chemiluminescence with the investigation of chromosome aberration, or with Ames and Comet test, SCE, FACS.

It is well known that the potential chemiluminescence of the polyaromatic hydrocarbons, the carcinogen benzo(a)pyrene, the dibenzathracene, and the dimethyl-benzanthracene was demonstrated by Anderson several years ago [W. Anderson, Nature (Lond.), 160, 892 (1947)]. He predicted with high farsightedness that metabolic hydroxylation of polyaromatic hydrocarbons is accompanied by chemiluminescence, which may cause malignant transformations. This was the original idea of the "dark" chemical, particularly biochemical reactions, in which processes a kind of excited state develops, promoting mutagenicity and carcinogenic effect of the polyaromatic hydrocarbons. Anderson's idea was reworded by several researchers, and his results were supported [C. S., Foote and S. Wexlker: J. Am. Chem. Soc., 86, 3879 (1964); E. H. White, J. Wiecke, D. R. Roswell: J. Am. Chem. Soc., 91, 5194 (1969); E. H. White, and C. C. Wei: J. Am. Chem. Soc., 92, 2167 (1970); E. H. White, E. Rapaport, H. H. Seliger, T. A. Hopkins: Bioorg. Chem., 1, 92 (1971); A. A. Lamola: Biochem. Biophys. Res. Commun. 43, 893 (1971)].

Subsequently, many investigations demonstrated that the cigarette smoke contains unstable molecules in high concentration, which in reaction with oxygen produce chemiluminescence. This chemiluminescence concentrates in the aerosol phase; it can be made absorbed in the glass wool filters of the combusting system, and can be extracted by organic solvents for the measurements. Here the investigations of Seliger and co-workers [H. H. Seliger, W. H. Biggley, J. P. Hamman, Science, 185 (147) 253-6 (1974)] must be highlighted, who demonstrated the oxygen-dependence of the chemiluminescence reactions, determined its kinetics, activation energy, studied the emission spectra and the absolute photon intensity. It was determined that not only the cigarette smoke exhibits spontaneous chemiluminescence, but also the side flow of the cigarette smoke: the pipe smoke, and the smoke of the leaves of the oak tree, maple, cornet and tea. The smoke of the cigarette paper or the wood shavings, exhibit much lower chemiluminescence. But it can be significantly measured in air samples transferred to glass wool, taken from the air of a room contaminated with tobacco smoke. Fresh cigarette smoke contains much more free radicals than the older smoke. Organic bases accelerate the attack of oxygen on the free radicals originating from the smoke and on the polyaromatic hydrocarbons. It is not absolutely necessary to connect chemiluminescence to the production of singlet oxygen. The pyrolysis products contain sufficient amount of unstable radicals to react directly with the ground state (triplet) oxygen. Kinetic order of the chemiluminescence indicates radical chain reaction mechanism. The tar and other latent carcinogenic molecules, which—mainly at the smokers—are already present in the lung and the chemiluminescence precursors originating from cigarette smoke, generate the excited state of these molecules, which promote carcinogenesis. The long lasting chemiluminescence originating from cigarette smoke demonstrates unambiguously that at the inhalation of the smoke the smokers get high intensity chemiluminescence dose, because of the retention.

Accordingly, the present invention relates to a special, highly efficient cigarette filter, which has the advantages of the solutions belonging to the state of the art, but at the same time eliminates their drawbacks to the most possible extent. In addition, the invention relates to the development of a cigarette filter with which chemiluminescence can be reduced.

Surprisingly it was found that if certain natural substances mentioned below are applied in the cigarette filter, the aim of the invention can be easily and successfully achieved.

In our studies it was found that reduction of the amount of free radicals, nicotine, tar, benzo(a)pyrene and other harmful substances can be realized most successfully, if a combination of polyphenol antioxidants is used in the filters. In the present invention grape pip and skin grist is used in the filters as antioxidant. Further in the filters astaxanthin and/or cranberry are used as antioxidants.

The grape pip and skin grist can be used alone or more preferably in admixture with other components mentioned below.

The astaxanthin is a naturally occurring carotinoid pigment, which has strong antioxidant activity. In addition astaxanthin has strong free radical removing activity, and protects against lipid peroxidation, oxidative damage of the LDL cholesterol, the cell membranes, the cells and the tissues. The antioxidant capacity of astaxanthin is 40 times higher than that of the betacarotin, and 1000 times higher than that of the vitamin E. The astaxanthin can be prepared for example from microalgae or salmon, and in many countries it is on the market as nutrient supplement; it doesn't contain substances harmful for the health. The astaxanthin can be obtained from the company AHD International LLC (Atlanta, US). The astaxanthin can be used alone or more preferably in admixture with other components mentioned below.

Cranberry is a naturally occurring fruit. It is very rich in antioxidants (anticianidins, tannins), which protect our organism from the harmful oxidation processes, save our body from ageing. It is recommended for the prevention of cardiovascular diseases, and because of its antibacterial effect, for the prevention and treatment of bacterial infections, which generally lead to inflammations, for strengthening the immune system, and as an appetizer. Fresh juice or concentrate can be prepared from the fruit, but dried fruit or fruit tea can also be prepared. In the filters of the invention the cranberry is used in grist form. The cranberry grist can be used alone or more preferably in admixture with other components mentioned below.

In one aspect of the invention as components with antioxidant activity grape components are used. Preferably, the pips and the skin are used. The pips and the skin of the grape are the side products of grape processing, and can be obtained from grape processing plants. A great advantage of the present invention is that the grape pip grist is available in large quantities at a very low price everywhere in the world where wine-growing and wine-processing occurs. As this starting material will be normally considered as waste or garbage, the present invention also distributes to the improvement of waste processing.

The pips and the skin can be used in the form of a grist. The grist of the grape pips is capable of solving the PAH (polyaromatic hydrocarbons) having lipophylic character, and beside the elimination of the chemiluminescence caused by the PAHs in excitated state it also removes the PAHs.

We also discovered that the grape pip grist treated with the extract of the grape skin is also suitable for obtaining the desired antioxidant level.

Preparation of such grists and treatment of the grists with the above mentioned extract is well known for any person skilled in the art, and can be carried out according to the methods generally used in food industry and pharmaceutical industry.

The grist can be applied in the form of two-component mixtures, preferably homogenous mixtures. As second component of the mixture for example large surface $AlOOH.H_2O$ and/or $Al_2O_3$ and/or silicoaluminate can be used. Further, active carbon, silica gel, alumina, zeolite, silica, cellulose particle, cellulose acetate particle, clay, sintered volcanic ash, starch particle and the mixtures thereof, and the like can also be used as second component. This second component is present in the mixture in an amount of 1-99% w/w. The above mentioned materials suitable as second components are all commerciable available, for example from MAL Rt. (Ajka, Hungary). For better results these second components can be treated with inert gases.

The specific surface of these second components can be selected from the widely range of not adversely affecting the activity of the grape pip and skin grist for instance about 1 to 10000 m2/g, preferably from 10 to 4000 m2/g (e.g. 10 to 2000 m2/g).

The average particle size of the homogenous mixture comprising the anti-oxidant and the second component can be 0.02-0.9 mm, for example 0.2-0.5 mm.

The greatest advantage of the cigarette filters of the invention is that they absorb not just the products of the particle phase (tar, nicotine, etc.) but also the products of the vapor phase, because, during burning, as a consequence of its structural water content, it transforms into hydrophilic gel, which can solubilize the toxic components of the cigarette smoke, neutralizes the free radicals, with an efficacy that pushes the amount of these harmful components far below health limit values. The grist of the grape pips is capable of solving the PAH (polyaromatic hydrocarbons) having lipophylic character, and beside the elimination of the chemiluminescence caused by the PAHs in excitated state it also removes the PAHs.

Further advantage of the invention is that using the antioxidants in combination with the second components above provides a synergistic effect resulting in significantly higher filtering capacity far exceeding that of the filters known from the prior art.

Further advantage of the invention is that the filter does not change the taste of cigarette during smoking to the contrary of the known solutions In order to support the above, new types of combined cigarette smoke filters were prepared. The two-component mixture comprising the antioxidant and the second component mentioned above was homogenized and filled into cavity filters.

Although for experimental purposes cavity filters have been used, it is obvious for a person skilled in the art that the invention can be carried out with all type of filters prepared in any way.

The amount of the two-component mixture comprising the antioxidant and the second component used in the filters depends on the particular cigarette to be smoked. For example the amount of the mixture can be 1-500 mg.

BRIEF DESCRIPTION OF THE DRAWING

FIG. 1. shows a diagram demonstrating the decrease of the intensity of chemiluminescence, compared to the control, in the filters of the invention. The upper curve is the control, the lower is the filter of the invention

MATERIALS

The following substances were used in the combined filters a) Large Surface $AlOOH.H_2O$

| | |
|---|---|
| Chemical composition: | $Al_2O_3$: 70% min |
| Specific surface: | 270 $m^2$/g (at least) |
| Specific gravity: | 250-350 g/L, |
| Pore volume: | 0.8 ml/g (at least) |
| Particle size distribution: | <25 micrometer: at least 20% |
| | <45 micrometer: at least 50% |
| | <90 micrometer: at least 85% |

Harmlessness of the product to health is officially proven.

b) Aluminium Oxide—$Al_2O_3$

| | |
|---|---|
| Bulk density. | 300-400 g/l |
| Specific surface: | 270 $m^2$/g (at least) |
| Specific gravity: | 300-400 g/L, |
| Pore volume: | 0.8 ml/g (at least) |
| Particle size distribution: | <25 micrometer: at least 20% |
| | <45 micrometer: at least 50% |
| | <90 micrometer: at least 90% |
| | >1000 0% |

Harmlessness of the product to health is officially proven.

c) Amorphous Silicoaluminate

Average particle size: 106 micrometer

Specific surface: 377 m2/g

Pore volume: 1.2 ml/g

Pore radius: 200 Å d) Antioxidants:

i) Polyphenols of the Pip and Skin Grist of the Grape

| Composition for 100 g | |
|---|---|
| Polyphenol | 4-10 g, preferably 6-7 g |
| Carbohydrate | 5.5 g |
| Fat | 6 g |
| Protein | 0.5 g |
| Water | 4 g |
| Particle size distribution | 0.2-0.6 mm |

The polyphenols were determined by the Folim-Denis method, photometrically, related to gallic acid. Free radical binding capacity was proven by the use of the Randox Total Antioxidant Status (Randox Laboratories Inc.) reagent kit.

ii.) Asthaxanthin iii) Cranberry (Vaccinum Macrocarpon) Dried Grist

Its polyphenol content is equal to that of the grist of the red grape.

METHODS OF MEASUREMENT

A) Chemiluminescence-Determination

Cigarettes were smoked and the smoke was immediately adsorbed in benzene.

Burning: whiffing number 37

Absorption liquid: benzene 5 ml

Measurement technique: Berthold BF 5000 liquid scintillation spectrometer

Measurement of the decrease of the relative intensity: 0.1/min

As mentioned above the smoke (aerosol phase) was directly absorbed in benzene, the 5 ml benzene solution was immediately transferred to a 20 ml glass cuvette, and after 2 minutes the change of the chemiluminescence was measured. 5 ml benzene was used for the background measurement, which didn't show chemiluminescence.

B) Investigation of the Adsorption of the Tritiated Radioactive Benzo(a)pyrene (BAP-$^3$H) on the Filter Parameters of the Investigation:

Applied radioactivity: 4.82 kBq/10 μl (289496 dpm)

Flow: 42-45 ml/min.

Liquid absorber: 1500 μl water

Activity measurement: 150 μl sample

Measurement technique: Berthold BF 5000 liquid scintillation spectrometer

Scintillator: Clinisosol™ 15 ml

Relative error of the method: 13.5%

It can be determined from the results that significant reduction can be reached in the adsorption of the toxic components of the cigarette smoke with the combinations, which result exceeds even the current EU specifications.

The investigations also show that by breaking the filter after burning, substance showing chemiluminescence could be dissolved from the $AlOOH_2O$, $Al_2O_3$ and silicoaluminate adsorbent layers with benzene. Mechanism of function of the filter can be characterized by the following: the adsorbent layer forms gel structure with the water content of the aerosol phase of the cigarette smoke, which can solubilize in micellar structure the apolar metabolites participating in the chemiluminescence reaction. In the course of the decrease of the chemiluminescence it was also observed that the components partly inhibit the generation of the free radicals, because through ion exchange and complex formation they reduce the extent of the Haber-Weiss reaction, which also occurs in the cigarette smoke:

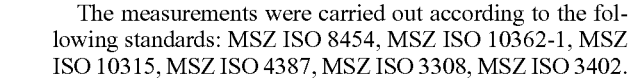

$$H_2O_2+Fe^{2+}\rightarrow .OH+OH^-Fe^{3+}\text{(Haber-Weiss reaction).}$$

The Fe adsorbs to the filter combination through ion exchange and complex generation, this way the reaction is inhibited.

In accordance with the afore-mentioned, the results of the measurement have demonstrated the advantage of the invention, according to which the filters of the invention adsorb not just the products of the particle phase but the products of the vapor/gas phase too.

The known and competent international organisations in the field of the controlling of the impact of smoking on health e.g. WHO, Canada Health, Deutsche Tabakverordnung, FDA in the USA request more and more biological tests for smoking, which might influence probably the future regulations and safety standards for cigarettes. In order to consider and meet such possible future safety standards timely and play a certain pioneer role in biological testing of cigarettes, the filters of the invention have undergone several such tests, the results of which also confirm their excellent quality. The biological test carried out with the filters of the invention shown significantly improved results to the commercially available filters.

The filters also significantly decreased the amount of $^{210}$Po present in the cigarette smoke. According to the latest research results $^{210}$Po is one of the main components of tobacco responsible for the development of lung cancer.

Further, the filters of the invention also significantly decreased the amount of the polycyclic aromatic hydrocarbons (PAH), especially benzo(a)pyrene proven to be the most potent carcinogenic component of the cigarette smoke.

1. Smoke Analysis

Cigarettes were smoked and the smoke was adsorbed on Cambridge filters. The measurements were conducted on a Cerulean 450 device (Molins PLC). The ventilation zones of the cigarettes were sealed with tapes.

The measurements were carried out according to the following standards: MSZ ISO 8454, MSZ ISO 10362-1, MSZ ISO 10315, MSZ ISO 4387, MSZ ISO 3308, MSZ ISO 3402.

| | | |
|---|---|---|
| Filter 1: | $AlOOH \cdot H_2O$: | 20 mg |
| | Grape pip and skin grist: | 50 mg |
| Filter 2: | control filter | |

Due to the use of the cigarette filters of the invention the tar, nicotine, CO, total condensate, and dry condensate values are significantly reduced. These effects are demonstrated by the physical data presented below:

i) Tar

| Sample ID | Tar mg/sample |
|---|---|
| 1 | 0.54 |
| 2 | 12.53 |

ii) Nicotine

| Sample ID | Nicotine mg/sample |
|---|---|
| 1 | 0.06 |
| 2 | 1.02 |

ii) CO

| Sample ID | CO mg/sample |
|---|---|
| 1 | 12.92 |
| 2 | 14.51 |

iv) TPM (Total Condensate)

| Sample ID | TPM mg/sample |
|---|---|
| 1 | 0.67 |
| 2 | 14.73 |

v) Water

| Sample ID | Water mg/sample |
|---|---|
| 1 | 0.14 |
| 2 | 1.18 |

vi) Dry Condensate

| Sample ID | DC mg/sample |
|---|---|
| 1 | 0.61 |
| 2 | 13.55 |

2. Chemical Tests

Cigarettes were smoked and the smoke was adsorbed on Cambridge filters. The measurements were conducted on a Cerulean 450 device (Molins PLC)

Due to the use of the cigarette filters of the invention the amount of phenol, formaldehyde, cyanide, acetaldehyde, $^{210}$Po heavy metal and PAH is significantly reduced. These effects are demonstrated by the physical data presented below:

a) Phenol

Based on MSZ/T 1484-9:2004 with dedicated sample preparation.

Sample preparation: 10 min ultrasonic assisted dissolution with 25 $cm^3$ ammoniac buffer (pH: 10), extraction by dichloromethane (2×10 $cm^3$), drying by $Na_2SO_4$, concentration to 1 $cm^3$.

Measurement:

System: HP6890N GC 5973N MS.

Detection mode: SIM.

Carrier gas: He 5.0.

Flow: 1.1 $cm^3/s$

Column: HP-5MS (25 m×0.25 mm×0.25 μm).

Temperature program: 50° C. (1.5 min), 12° C./min, 90° C., 5° C./min, 190° C., 30° C./min, 300° C. (3 min).

Injector temp.: 280° C.

Injection mode: pulsed splitless (150 kPa, 1 min), 2 μl (HP 7683 ALS)
Interface temp.: 300° C.
Calculation: based on external calibration.
Results:

| Sample ID | Phenol μg/sample |
|---|---|
| 1 | 41.3 |
| 2 | 294 |
| 3 | 0.15 |

| | | |
|---|---|---|
| Filter 1: | $AlOOH \cdot H_2O$: | 20 mg |
| | Grape pip and skin grist: | 50 mg |
| Filter 2: | control filter | |
| Filter 3: | blank Cambridge filter | |

b) Formaldehyde

Based on EPA 8315 with dedicated sample preparation.

Sample preparation: 10 min ultrasonic assisted dissolution with 25 $cm^3$ acetate buffer (pH: 5), conversion with DNPH (6 $cm^3$, 1 h, 40° C.), clean-up by SPE (C18 500 mg), elution by 10 $cm^3$ acetonitrile.
Measurement:
System: Agilent 1100 HPLC
Detector: DAD 360 nm.
Eluent: 70/30 v/v acetonitrile/water (0 min); 1 min 100% acetonitrile (5 min)
Flow: 1.2 $cm^3/s$
Column: WATERS SYMMETRY C18 (250 mm×4.6 mm×0.5 μm).
Injected volume: 20 μl
Calculation: based on standard addition.
Results:

| Sample ID | Formaldehyde μg/sample |
|---|---|
| 1 | 11.1 |
| 2 | 28.2 |
| 3 | 2.43 |

| | | |
|---|---|---|
| Filter 1: | $AlOOH \cdot H_2O$: | 20 mg |
| | Grape pip and skin grist: | 50 mg |
| Filter 2: | control filter | |
| Filter 3: | blank Cambridge filter | |

c) Total Cyanide

Based on MSZ 21978/17:1985

Sample preparation: waterstream-destiallition from acidic solution containing Cu(II) and Sn(II), collection in basic solution. Conversion to glutacon dialdehyde.

Measurement: photometric measurement on 578 nm from solution containing barbituric acid
Results:

| Sample ID | Cyanide μg/sample |
|---|---|
| 1 | 19.1 |
| 2 | 155 |
| 3 | <5.0 |

| | | |
|---|---|---|
| Filter 1: | $AlOOH \cdot H_2O$: | 20 mg |
| | Grape pip and skin grist: | 50 mg |
| Filter 2: | control filter | |
| Filter 3: | blank Cambridge filter | |

d) Acetaldehyde

Based on EPA 8315 with dedicated sample preparation.

Sample preparation: 10 min ultrasonic assisted dissolution with 25 $cm^3$ citrate buffer (pH: 3), conversion with DNPH (6 $cm^3$, 1 h, 40° C.), clean-up by SPE (C18 500 mg), elution by 10 $cm^3$ acetonitrile.
Measurement:
System: Agilent 1100 HPLC
Detector: DAD 360 nm.
Eluent: 70/30 v/v acetonitrile/water (0 min); 1 min 100% acetonitrile (5 min)
Flow: 1.2 $cm^3/s$
Column: WATERS SYMMETRY 018 (250 mm×4.6 mm×0.5 μm).
Injected volume: 20 μl
Calculation: based on standard addition.
Results:

| Sample ID | Acetaldehyde μg/sample |
|---|---|
| 1 | 120 |
| 2 | 400 |
| 3 | 10 |

| | | |
|---|---|---|
| Filter 1: | $AlOOH \cdot H_2O$: | 20 mg |
| | Grape pip and skin grist: | 50 mg |
| Filter 2: | control filter | |
| Filter 3: | blank Cambridge filter | |

e) $^{210}Po$ Absorption

Sample preparation: extraction with 2 m HCl
Measurement:
Number of cigarettes burnt: 5
Samples Examined:

1) Cambridge filter after burning (after the filter of the invention)
2) Cambridge filter after burning (after the cellulose acetate only)
3) Cambridge filter (without burning/blind/)

Measurement method used: Liquid scintillation spectrometry
System: Perkin Elmer TR 2800 liquid scintillation spectrometer optimalized for the measurement of α-radiation
Liquid scintillator: Ultimagold+(Perkin Elmer)
Measurement volume: 20 ml
Measurement time: 20 min/sample
Standard deviation: δ=1.75%
Results:

| Sample | Radioactivity pCi/5 cigarette |
|---|---|
| 1 | 1.5 |
| 2 | 6.7 |
| 3 | 0 |

The results show that the filter of the invention absorbed 77.6% of the radioactivity compared to the cellulose acetate filter.

The results may seem relative high for one cigarette, although the respective literature indicates highly different levels; also differences in order can be found. This may be due to the differences in the use of the phosphate fertilizer on, the main source of $^{210}Po$ for the tobacco plants. The method used for the measurement is not simple either. According to the above the results obtained with the filter of the invention have to be considered as very surprising and outstanding. The international statistics supporting that the decrease in the level of $^{210}Po$ in the tobacco reduces the incidence of lung cancer, are well known for a person skilled in the art.

f) Heavy Metal Elements

Measurement based on EPA method 6010B: 1996, from digestion with aqua to regia.

Results:

| Elements | Unit | Sample ID 1 | 2 | 3 |
|---|---|---|---|---|
| Arsenic[1] | µg/sample | 3.9 | 5.4 | 3.0 |
| Cadmium[1] | µg/sample | 0.51 | 0.78 | 0.18 |
| Chrome[1] | µg/sample | 4.5 | 9.9 | 3.0 |
| Copper[1] | µg/sample | 1.8 | 8.4 | 1.5 |
| Nickel[1] | µg/sample | 0.3 | 0.9 | <0.1 |
| Lead[1] | µg/sample | 7.2 | 22.2 | 0.84 |
| Zinc[1] | µg/sample | 4830 | 34800 | 1140 |
| Mercury[2] | µg/sample | <0.01 | <0.01 | <0.01 |

| | | |
|---|---|---|
| Filter 1: | $AlOOH \cdot H_2O$: | 20 mg |
| | Grape pip and skin grist: | 50 mg |
| Filter 2: | control filter | |
| Filter 3: | blank Cambridge filter | |

Test equipment:
[1]PE Optima 5300DV ICP-OES
[2]Perkin-Elmer FIMS-400 Hg-AAS g) Polyaromatic Hydrocarbons (PAH)

Measurement based on EPA method 8260 with dedicated sample preparation.

Sample preparation: 10 min ultrasonic assisted dissolution with 10 $cm^3$ dichloromethane. Test equipment: Agilent 6890N-5973i GCMS with Gerstel MPS-2 autosampler.

Results:

| Compounds | Unit | Sample ID 1 | 2 | 3 |
|---|---|---|---|---|
| Naphthalene | µg/sample | 0.03 | 1.37 | 0.01 |
| 2-Methylnaphthalene | µg/sample | 0.03 | 1.46 | 0.01 |
| 1-Methylnaphthalene | µg/sample | 0.04 | 1.63 | 0.01 |
| Acenaphthylene | µg/sample | <0.01 | <0.01 | <0.01 |
| Acenaphthene | µg/sample | <0.01 | <0.01 | <0.01 |
| Fluorene | µg/sample | 0.04 | 1.01 | <0.01 |
| Fenanthrene | µg/sample | 0.07 | 0.80 | 0.02 |
| Anthracene | µg/sample | 0.02 | 0.34 | <0.01 |
| Fluoranthrene | µg/sample | 0.04 | 0.38 | <0.01 |
| Pyrene | µg/sample | 0.03 | 0.36 | <0.01 |
| Benzo(a)anthracene | µg/sample | <0.01 | 0.10 | <0.01 |
| Chrysene | µg/sample | <0.01 | 0.11 | <0.01 |
| Benzo(a)fluoranthene | µg/sample | <0.01 | 0.06 | <0.01 |
| Benzo(k)fluoranthene | µg/sample | <0.01 | 0.06 | <0.01 |
| Benzo(e)pyrene | µg/sample | <0.01 | <0.01 | <0.01 |
| Benzo(a)pyrene | µg/sample | <0.01 | 0.06 | <0.01 |
| Indeno[1,2,3-c,d]pyrene | µg/sample | <0.01 | 0.02 | <0.01 |
| Dibenzo(a,h) anthracene | µg/sample | <0.01 | <0.01 | <0.01 |
| Benzo(g,h,i)perilene | µg/sample | <0.01 | <0.01 | <0.01 |
| Total PAH | µg/sample | 0.30 | 7.76 | 0.05 |

| | | |
|---|---|---|
| Filter 1: | $AlOOH \cdot H_2O$: | 20 mg |
| | Grape pip and skin grist: | 50 mg |
| Filter 2: | control filter | |
| Filter 3: | blank Cambridge filter | |

From the above results the most important data is Total PAH. This data shows that the filter of the invention reduced the amount of all polyaromatic hydrocarbons in a significant way.

3. Biological Tests a) Antioxidant Capacity

The aim of the study was the examination of the antioxidant capacity changes in a mammalian cell line produced by treatment with the filters of the invention and control filters.

Cigarettes were smoked and the smoke was adsorbed on Cambridge filters. The measurements were conducted on a Cerulean 450 device (Molins PLC)

The study was performed in compliance with the requirements of GLP. The study was conducted/performed regarding the following regulations: 9/2001.

(III.30) EÜM-FVM about the good laboratory practice as well as the OECD Guidance Document on the Principles on Good Laboratory Practice [ENV/MC/CHEM (98)17].

Principle of the Method:

In the $H_2O_2$/.OH microperoxidase system free radicals are generated from $H_2O_2$ by the addition of Fe(III). The free radicals excite the reagent Luminol and escaping photons are detected in the measuring equipment. Any added biological sample reduces the photon-emission of Luminol by capturing the electrons derived from decomposition of $H_2O_2$. There is a direct relationship between the redoxy properties of the biological sample and the amount of luminescence generated in the system.

The electron taking capacity of filter extractums was measured by chemiluminescence method, with Diachem kit, with Perkin-Elmer Victor multilabel reader luminometer. The evaluation was made with Wallac 1420 software. The electron taking capacity was examined both in cell and cell-free systems:

i) In cell free systems the sample can keep back the materials containing unsteady bipolar bounds, which are therefore capable of taking electrons several times as efficiently as conventional filters.

ii) in cell system the combined the filters of the invention affected the antioxidant capacity of cells also several times as efficiently as conventional.

Results: Free Radical Capturing Activity Measurement in Cell Free System

| | empty Cambridge filter Relative luminescence % | | | |
|---|---|---|---|---|
| Conc. % | TEST 1 | TEST 2 | average | sd |
| 50 | 99.4 | 97.65 | 98.53 | 1.24 |
| 25 | 100.2 | 97.5 | 98.85 | 1.91 |
| 12.5 | 96.7 | 95.2 | 95.95 | 1.06 |
| 6.25 | 109.4 | 98.8 | 104.1 | 7.5 |
| 3.12 | 102.3 | 115 | 108.65 | 9.0 |
| 1.56 | 108 | 100 | 104 | 5.65 |
| Ctr. | 100 | 100 | 100 | — |

| | Control filter Relative luminescence % | | | |
|---|---|---|---|---|
| Conc. % | TEST 1 | TEST 2 | average | sd |
| 50 | 0.6 | 0.5 | 0.55 | 0.07 |
| 25 | 0.8 | 0.6 | 0.63 | 0.13 |
| 12.5 | 1.9 | 1.7 | 1.80 | 0.14 |
| 6.25 | 6.6 | 9.15 | 7.88 | 1.80 |
| 3.12 | 33.3 | 27.27 | 30.29 | 4.30 |
| 1.56 | 69.9 | 63.97 | 70.00 | 4.26 |
| Ctr. | 100 | 100 | 100 | — |

| | Filter of the invention Relative luminescence % | | | |
|---|---|---|---|---|
| Conc. % | TEST 1 | TEST 2 | average | sd |
| 50 | 7.1 | 1.9 | 4.50 | 3.70 |
| 25 | 21 | 25 | 23.00 | 2.80 |
| 12.5 | 30.9 | 33.4 | 32.15 | 1.76 |
| 6.25 | 47.2 | 55.1 | 51.15 | 5.60 |
| 3.12 | 60.5 | 66.4 | 63.45 | 4.17 |
| 1.56 | 95.9 | 89 | 92.45 | 4.88 |
| Ctr. | 100 | 100 | 100 | — |

24 hrs Treatment of HepG2 Cells Followed by Antioxidant Measurement

| | empty Cambridge filter Relative luminescence % | | | |
|---|---|---|---|---|
| Conc. % | TEST 1 | TEST 2 | average | sd |
| 50 | 79.43 | 86.61 | 83.02 | 5.07 |
| 25 | 80.37 | 89.35 | 84.86 | 6.35 |
| 12.5 | 82.93 | 90.90 | 86.92 | 5.64 |
| 6.25 | 85.63 | 93.35 | 89.49 | 5.46 |
| 3.12 | 96.01 | 96.04 | 96.03 | 0.02 |
| 1.56 | 100.39 | 10.58 | 100.5 | 0.13 |

| | Control filter Relative luminescence % | | | |
|---|---|---|---|---|
| Conc. % | TEST 1 | TEST 2 | average | sd |
| 50 | 5.82 | 11.57 | 8.70 | 4.07 |
| 25 | 11.96 | 22.09 | 17.03 | 7.16 |
| 12.5 | 23.22 | 28.46 | 25.84 | 3.71 |
| 6.25 | 32.70 | 37.76 | 35.23 | 3.58 |
| 3.12 | 74.38 | 72.41 | 73.40 | 1.40 |
| 1.56 | 88.62 | 89.31 | 88.97 | 0.49 |

| | Filter of the invention Relative luminescence % | | | |
|---|---|---|---|---|
| Conc. % | TEST 1 | TEST 2 | average | sd |
| 50 | 27.11 | 35.63 | 31.37 | 6.02 |
| 25 | 47.26 | 56.66 | 51.96 | 6.65 |
| 12.5 | 74.09 | 70.23 | 72.16 | 2.73 |
| 6.25 | 91.93 | 87.50 | 89.72 | 3.13 |
| 3.12 | 95.42 | 94.94 | 95.18 | 0.34 |
| 1.56 | 98.84 | 97.09 | 97.97 | 1.24 |

b) Examination of Genotoxicity by SCE (Sister Chromatid Exchange)

The aim of the study was the examination of genotoxicity by sister chromatiod exchange (SCE) in a mammalian cell line produced by treatment with smoke extracts passed through the filters of the invention and control filters.

The study was performed in compliance with the requirements of GLP. The study was conducted/performed regarding the following regulations: 9/2001. (III.30) EÜM-FVM about the good laboratory practice as well as the OECD Guidance Document on the Principles on Good Laboratory Practice [ENV/MC/CHEM (98)17]. The study is performed following the directions of OECD Test Guideline 479 (Genetic Toxicology: In vitro Sister Chromatoid Exchange Assay in Mammalian Cells, Original Guideline, adopted 23 Oct. 1986).

The tests showed that the filters of the invention are also able to decrease the amount of the dangerous genotoxic chemical substances. Due to this capability the filters of the invention significantly decrease the risk of chromosome damage.

Study: 4 hrs Treatment

| Sample | conc. % | SCE avg. per cell | Statistical evaluation |
|---|---|---|---|
| Empty Cambridge filter extract | 6.25 | 15/40 0.375 | n.s |
| | 3.125 | 18/40 0.450 | n.s. |
| | 1.56 | 13/40 0.325 | n.s. |
| Control filter extract | 12.5 | — | — |
| | 6.25 | 227/40 5.675 | $p < 0.001$ |
| | 3.125 | 55/40 1.375 | $p < 0.01$ |
| | 1.56 | 37/40 0.925 | $p < 0.05$ |
| Extract of the filter of the invention | 12.5 | — | — |
| | 6.25 | 91/40 2.275 | $p < 0.001$ |
| | 3.125 | 28/40 0.700 | $p < 0.01$ |
| | 1.56 | 16/40 0.400 | n.s. |
| Untreated control | — | 10/40 0.250 | — |

c) Mammalian Cell Cycle In Vitro (Fluorescence Activated Cell Sorter)

The aim of the study was the determination of the effect of smoke extract from cigarettes with the filters of the invention and control filters on the mammalian cell cycle in vitro.

The study was performed in compliance with the GLP. The study was conducted/performed regarding the following regulations: 9/2001. (III.30) EÜM-FVM about the good laboratory practice as well as the OECD Guidance Document on the Principles on Good Laboratory Practice [ENV/MC/CHEM (98)17].

Principles of flow cytometric study: the method is suitable to determine the is cell cycle distribution of a cell population on the basis of the DNA content of each cell. Data can be obtained on the proportion of cycling cells and apoptotic population.

The results showed that the filters of the invention are capable of absorbing the harmful substances present in the cigarette smoke and damage cell proliferation. In this respect the filters of the invention are significantly more effective compared to the conventional filters.

Summary of Experimental FACS Data

| sample | conc. % | Apoptosis % | average ± SD | S phase % | average ± SD |
|---|---|---|---|---|---|
| empty | 6.25 | 2.20; 1.26 | 1.73 ± 0.66 | 79.25; 55.23 | 67.24 ± 17 |
| Cam- | 3.12 | 0.58; 0.80 | 0.69 ± 0.15 | 76.89; 59.92 | 68.20 ± 12.3 |
| bridge | 1.56 | 0.48; 0.72 | 0.60 ± 0.17 | 74.19; 55.44 | 64.815 ± 13 |
| flter | 0.78 | 0.75; 1.22 | 0.985 ± 0.33 | 78.91; 54.51 | 66.71 ± 17 |
| Control | 12.50 | 2.54; 2.19 | 2.365 ± 0.25 | 3.98; 5.20 | 4.59 ± 0.86 |
| filter | 6.25 | 1.07; 4.04 | 2.55 ± 2.1 | 26.08; 51.83 | 38.96 ± 18.2 |
| | 3.12 | 0.70; 2.74 | 1.72 ± 1.44 | 68.00; 56.54 | 62.27 ± 8.1 |
| | 1.56 | 0.45; 2.60 | 1.52 ± 1.25 | 71.45; 56.27 | 63.86 ± 10.7 |
| Filter | 12.50 | 0.86; 3.81 | 2.335 ± 2.08 | 70.63; 55.58 | 63.105 ± 10.6 |
| of the | 6.25 | 0.78; 0.74 | 1.095 ± 0.5 | 69.57; 68.16 | 59.18 ± 12.07 |
| inven- | | 1.83; 1.03 | | 43.96; 55.03 | |
| tion | 3.12 | 0.73; 1.32 | 0.915 ± 0.28 | 70.41; 74.79 | 61.57 ± 14 |
| | | | | 43.75; 57.37 | |
| | 1.56 | 0.95 | 0.95 | 77.46 | 77.46 |
| control | — | 0.90; 2.23 | 1.56 ± 0.94 | 74.76; 57.04 | 65.9 ± 12.5 |

4. Synergistic Effect

The effect of the single components as well as the effect of the homogenous mixture on the components of the cigarette smoke were examined in a Cerulean SM 450 device. The test were carried out according to the standards MSZ ISO 8454, 10362-1, 10315, 4387, 3308, 3402.

The $AlOOH.H_2O$ and the grape pip and skin grist as well as their mixture were placed into cellulose acetate. As control cellulose acetate was used.

| Parameters (mg/cigarette) | $AlOOH \bullet H_2O$ 20 mg (1) | Grape pip and skin grist 20 mg (2) | (1) + (2) | Control |
|---|---|---|---|---|
| Total condensate | 8.69 | 9.88 | 5.94 | 10.46 |
| Dry condensate | 8.09 | 9.26 | 5.60 | 9.68 |
| Water | 0.6 | 0.6 | 0.34 | 0.78 |
| Nicotine | 0.54 | 0.62 | 0.36 | 0.64 |
| Tar | 7.55 | 8.64 | 5.24 | 9.04 |

The above table clearly shows the synergistic effect of the components.

Summary

Significantly lower SCE (sister chromatide exchanges) were found in the extracts of the filter of the invention compared to the extracts of commercially available standard filters. This clearly proves, that filters of the invention remove much more dangerous, genotoxic substances from the smoke than standard filters.

The condensate extracts of the filter of the invention exhibit significantly (4 times) lower cytotoxicity compared to the standard filter extracts.

The condensate extracts of the filters of the invention shows much lower scavenger activity than the control filter extracts, i.e. the filter of the invention retains much more toxic, labile, double-bonded substances capable of electron capturing than control filter does, by other words, the filters of the invention let pass through much less harmful components. In the cellular antioxidant assay the control filter extract caused a four-time decrease in the cellular antioxidant capacity compared to the extracts of the filters of the invention, i.e. the filters of the invention let passing through much less harmful substances than the control standard filter.

The control standard condensate inhibited cell proliferation in the two higher doses tested while the condensate extract of the filters of the invention did not.

The invention claimed is:

1. Special cigarette filter eliminating genotoxicity (SCE, FACS) exhibiting high antioxidant capacity, significantly decreasing the amount of $Po^{210}$, decreasing the amount of polycyclic aromatic hydrocarbons (PAH), especially benzo (a)pyrene, lowering the amount of heavy metal elements and for he filtration of toxic gas fumes and reducing the amount of free radicals in the cigarette smoke wherein the filter mentioned contains, in addition to the common components of known cigarette filters $AlOOH.H_2O$, and/or $Al_2O_3$ and/or silicoaluminate; and grape pip and skin grist as antioxidant; and optionally astaxanthin and/or cranberry as further antioxidants.

2. A cigarette filter according to claim 1, comprising 10-90% $AlOOH:H_2O$ and/or $Al_2O_3$ and/or silicoaluminate and 90-10% antioxidant.

3. A cigarette filter according to claim 1, wherein the grape pip and skin grist is obtained from white grape.

4. A cigarette filter according to claim 1, wherein the grape pip and skin grist is obtained from red grape.

5. A cigarette filter according to claim 2, wherein the grape pip and skin grist is obtained from white grape.

6. A cigarette filter according to claim 2, wherein the grape pip and skin grist is obtained from red grape.

* * * * *